US005540519A

United States Patent [19]

Weber

[11] Patent Number: 5,540,519

[45] Date of Patent: Jul. 30, 1996

[54] PORTABLE VIBRATORY WET SCREED

[76] Inventor: Doug J. Weber, P.O. Box 5026, Bella Vista, Ark. 72714

[21] Appl. No.: 381,485

[22] Filed: Jan. 31, 1995

[51] Int. Cl.[6] ..... E01C 19/40

[52] U.S. Cl. ..... 404/102; 404/114; 15/235.4

[58] Field of Search ..... 404/97, 114, 115, 404/118, 102; 15/235.4

[56] References Cited

U.S. PATENT DOCUMENTS

| | | | |
|---|---|---|---|
| 2,289,248 | 7/1942 | Davis | 404/113 X |
| 4,030,873 | 6/1977 | Morrison | 404/114 X |
| 4,650,366 | 3/1987 | Morrison | 404/114 |
| 4,702,641 | 10/1987 | Naser et al. | 404/97 |
| 5,375,942 | 12/1994 | Lindley et al. | 404/97 |

FOREIGN PATENT DOCUMENTS

| | | | |
|---|---|---|---|
| 1417130 | 10/1965 | France | 404/118 |
| 173454 | 11/1960 | Sweden | 404/118 |

*Primary Examiner*—Ramon S. Britts

*Assistant Examiner*—James A. Lisehora

*Attorney, Agent, or Firm*—Aquilino & Welsh

[57] ABSTRACT

An extremely light-weight, portable floating power vibratory concrete "Wet Screed", which is hand operated by a single finisher in order to strike off, tamp and smooth freshly poured concrete using only perimeter slab forms or curbs. The unique angular design of the enclosed hollow screed blade allows the operator to lower the handle and effectively use the rear 60 degree angled surface of the screed blade to cut down the height of the concrete to the desired grade, or raise the handle to effectively use the front 60 degree angled surface of the screed blade to float and maintain the desired grade. The flat aluminum bottom extending from the front angled surface to the rear angled surface of the screed blade functions to produce a smooth, near final finish while the vibratory action tamps the rock down and works the fat to the concrete surface, thereby substantially increasing the finishing time while making the finisher's job much easier. With the new invention, it is possible to "Wet Screed" and then finish, in one day, twice the amount now possible by hand and with less labor.

12 Claims, 8 Drawing Sheets

PORTABLE VIBRATORY WET SCREED

BACKGROUND OF THE INVENTION

The present invention relates to concrete screeds and, in particular, to extremely light weight, single operator, portable power vibratory "Wet Screeds" used to smooth and level freshly poured concrete without use of forms or other devices to ride or rest on, but rather floats on the concrete as it tamps and smooth the preparatory to final finishing.

To date, there exists no other prior art device which accomplishes these tasks simultaneously as does this invention.

Numerous screeds employ vibratory action to tamp and smooth the concrete in the final finishing step. U.S. Pat. No. 4,340,351 describes a vibratory concrete screed requiring two operators which is used in the final finishing of concrete. U.S. Pat. No. 4,641,995 describes a vibratory concrete screed which rides on forms to screed narrow strips of concrete such as walks. The screed in this patent is mounted on the operator via a complicated harness counter-weighted frame and is powered by electricity thus requiring the manipulation of lengthy extension cords and having electrical power on site.

Escalating labor costs and the unavailability of qualified concrete helpers has pushed the concrete finishers profitability margin down continually, thus forcing rising costs of construction nationwide. The current standard method of "Wet Screeding" freshly poured concrete is with a 2" by 4" board 8' to 12' long with one or two men bent over all day long, hand working the concrete as two to four laborers, "puddlers", push the fresh concrete, "mud", in place with concrete rakes. The hand process is not only slow, inefficient and labor intensive, it is also conducive to the addition of more water to the mix in order to make it more workable thus reducing the strength of the concrete, which can cause voids and weak spots. The addition of water to produce slumps of 6" to 8" so the finisher can effectively hand "Wet Screed" the fresh concrete is common in the industry nationwide today. The hand process limits the finisher to the average pour of 6,000 to a maximum of 8,000 square feet of slab per day for a crew of six.

SUMMARY OF THE INVENTION

The present invention allows the "Wet Screeding" of 4" to 5" slump concrete quickly and efficiently with only one operator and two puddlers, while doubling the potential daily pour to 13,000 to 16,000 square feet per day, literally as fast as the concrete trucks can pour it. This increased efficiency also doubles the income potential of the concrete finisher. Simultaneously, this invention with its floating vibratory action produces a much higher quality slab of greater strength and no voids or weak spots, allowing one additional hour for final finishing by working the rock down and the fat to the surface.

The invention's extremely light weight portability and ease of operation by a single operator, not only doubles the potential surface area that can be efficiently wet screeded each day, it also reduces the size of the crew required to four (4) rather than the normal six (6) required with conventional hand wet screeding methods.

The invention's increased efficiency through power vibratory wet screeding, thus doubling the income potential, combined with the reduction of overhead in personnel required, thereby triples the daily net profit potential from operations to the professional concrete finisher.

In accordance with the enclosed embodiments of the invention, the unique 60 degree angled enclosed 6" equilateral triangular, 1/16" thick aluminum skinned, power vibratory screed, 10' in length produces a nearly finished, high quality slab in the "Wet Screeding" of freshly poured concrete. The single operator is able to quickly build a series of parallel wet screed bases off grade pins, set on a 10' grid by laser the desired finished grade elevation. Once the operator has struck off the grade pins approximately 2' wide in parallel rows for the wet screed base, the single operator then lifts the invention and quickly wet screeds off the 10' parallel sections for the full length of the pour.

The invention's smooth 6" base of 1/16" thick aluminum, combined with the unique 60 degree angled enclosed equilateral triangular screed blade faces and the power vibratory action of the invention quickly works the rock down and the fat to the surface, producing a very smooth, nearly finished slab to grade. This action produces a top quality slab and adds one hour to the final finishing time, greatly enhancing the quality and doubling the potential surface area which a crew can efficiently produce each day with less overhead.

Even doubling the area of production, the crew and operator of the invention are vastly less physically fatigued at days end due to the ease of operation of the invention and its efficient high quality work. This is one of the most valuable benefits of the invention since it is directly beneficial to the health and well being of both operator and crew.

The extremely light weight, enclosed triangular 60 degree design, allowing the invention to float on the surface of freshly poured concrete, combined with the power vibratory action forcing the rock down, allows the 60 degree faces to cut the high spots down as needed by lowering the handle, or to float over and tamp down to maintain the proper grade by raising the handle.

Additionally, due to the invention's light weight an operator can when required, utilize the device as a bull float temporarily, with the power vibratory action on idle, to smooth out a spot or two inadvertently missed by the operator.

Other objects and advantages of the present invention will become apparent from the following detailed description when viewed in conjunction with the accompanying drawings, which set forth certain embodiments of the invention.

BRIEF DESCRIPTION OF THE DRAWINGS

The invention is described in greater detail in the following description of the preferred embodiments of the invention, taken in conjunction with the drawings, in which.

DESCRIPTION OF THE PREFERRED EMBODIMENTS

Figure 1:
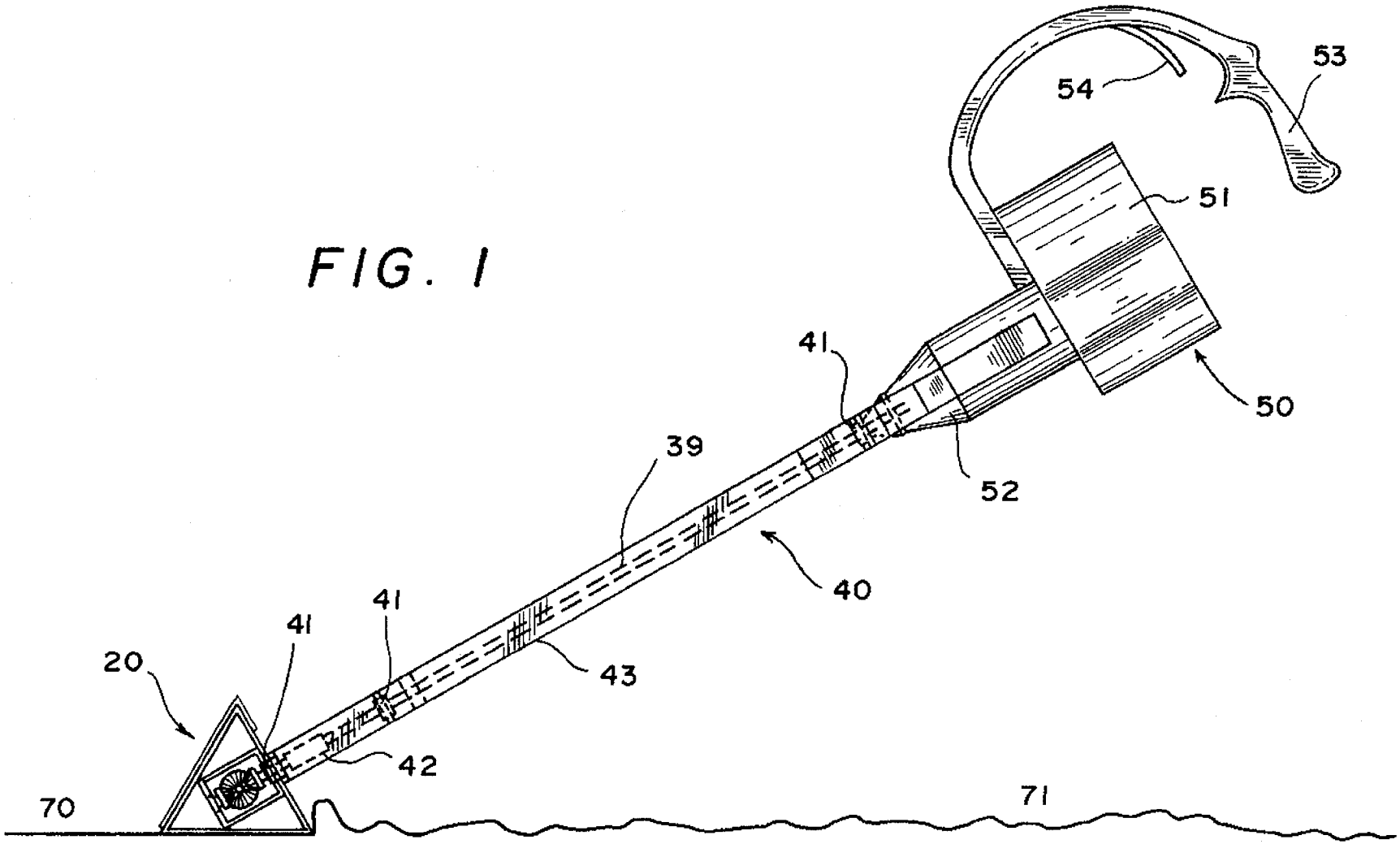
FIG. 1 is a side view of the portable power vibratory "Wet Screed" according to the invention when in use.
Figure 2:
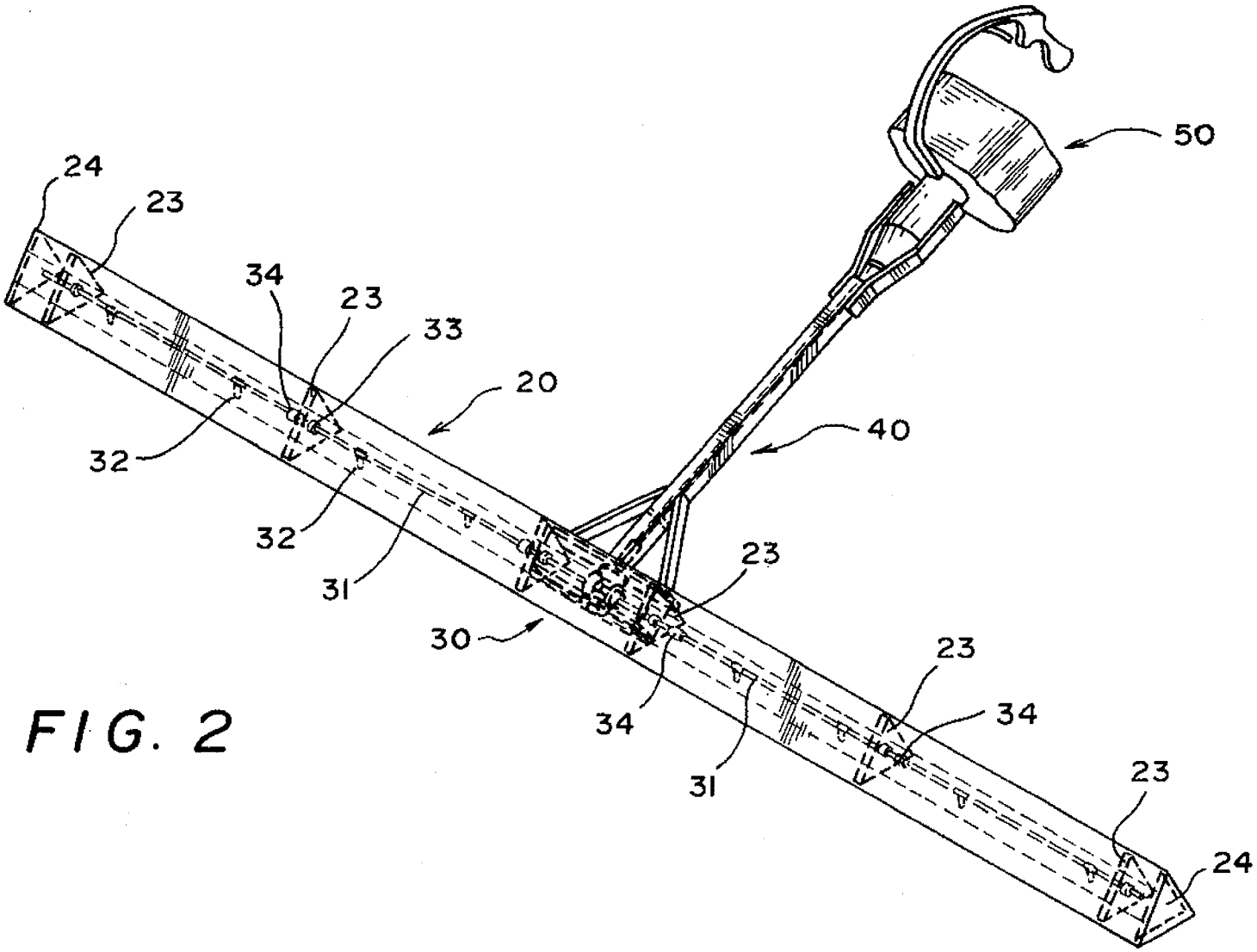
FIG. 2 is a perspective view of the portable vibratory screed shown in FIG. 1.
Figure 3:
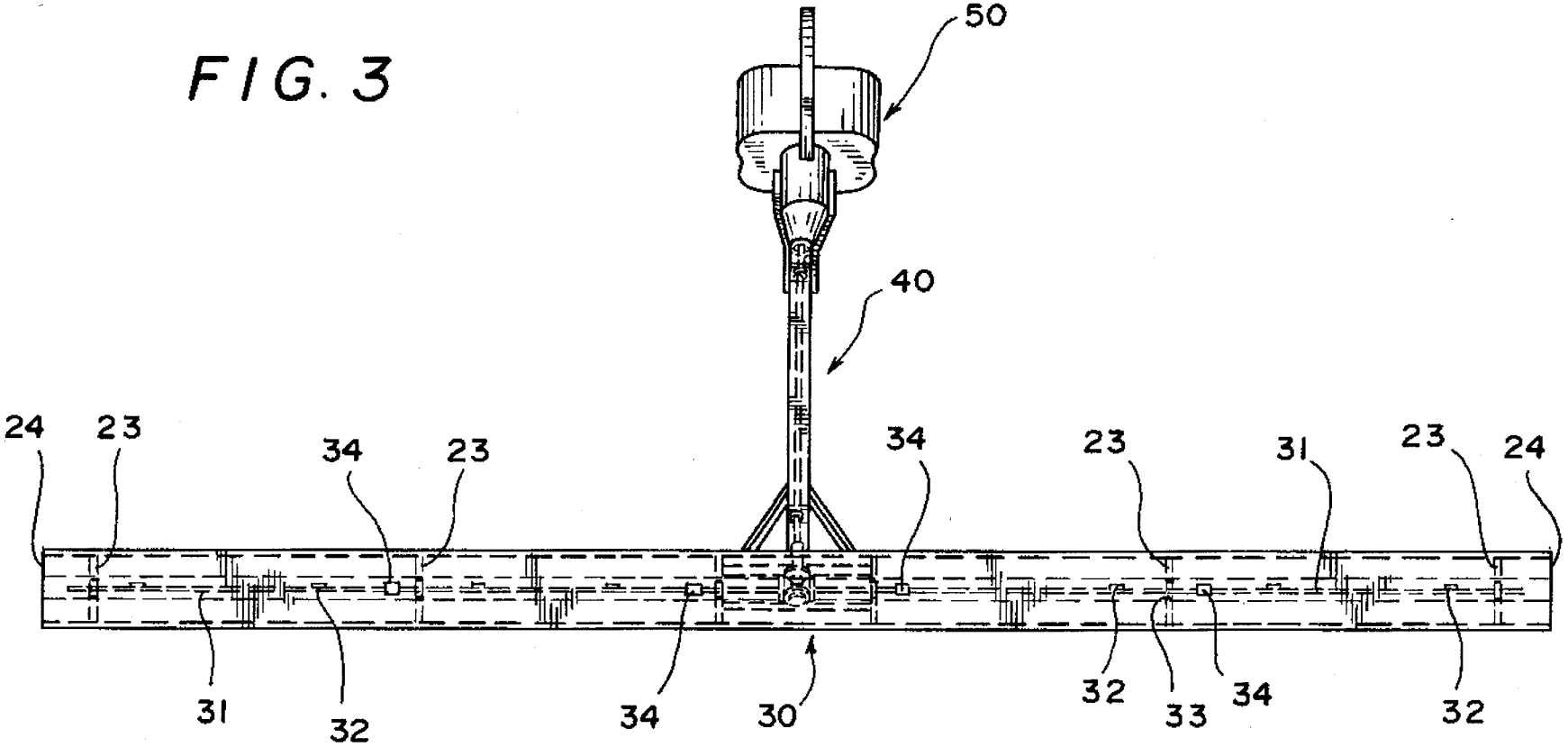
FIG. 3 is a front view of the portable vibratory screed shown in FIG. 1.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to the drawings, the present invention 10 is shown to include a uniquely designed screed blade 20, a vibratory system 30 within said blade, a handle assembly 40 and a motor assembly 50 attached to and cooperating with the handle assembly.

Figure 4:
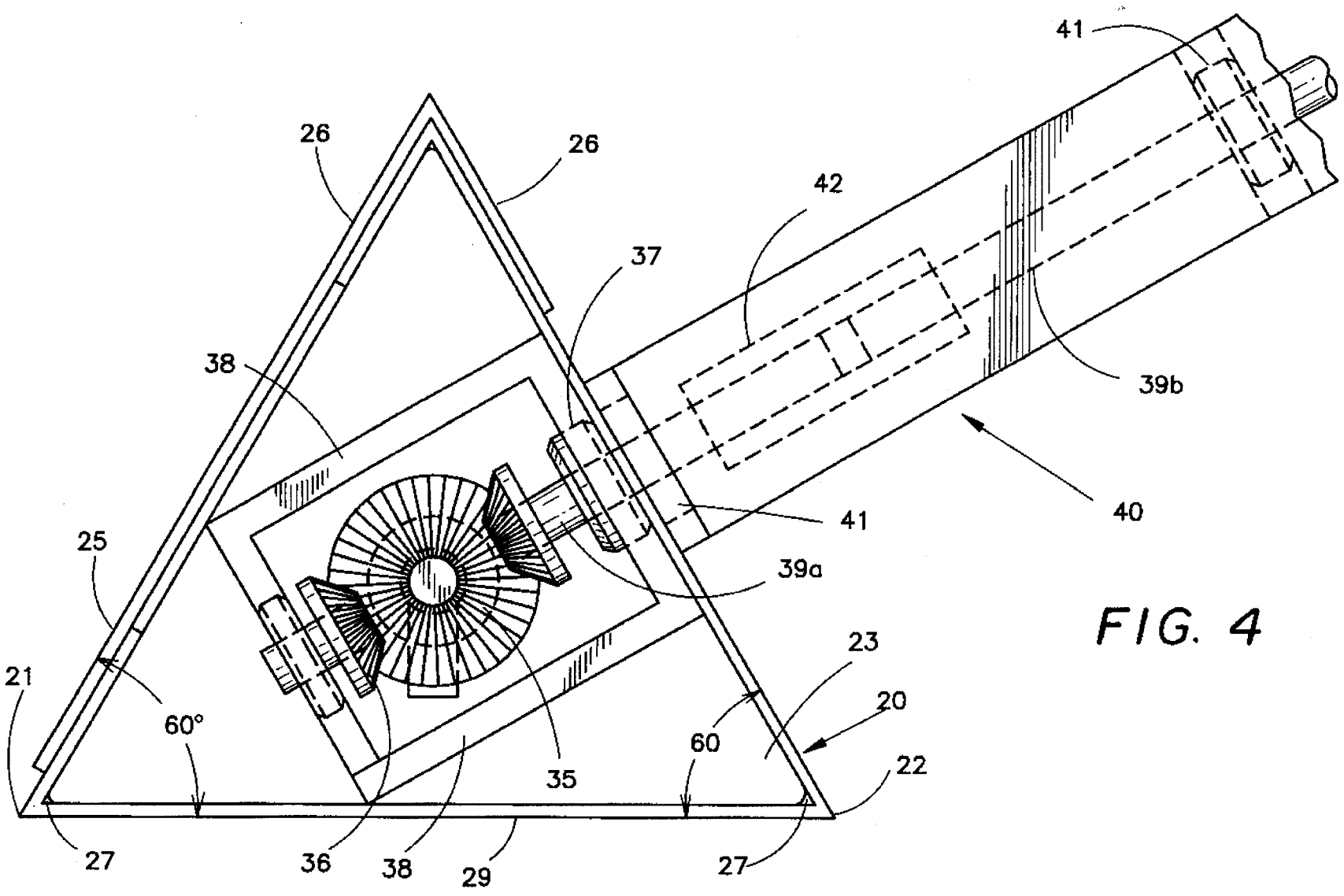
FIG. 4 is a diagrammatic sectional skeletal view of the portable vibratory screed body shown in FIG. 1 illustrating the component parts.
Figure 8:
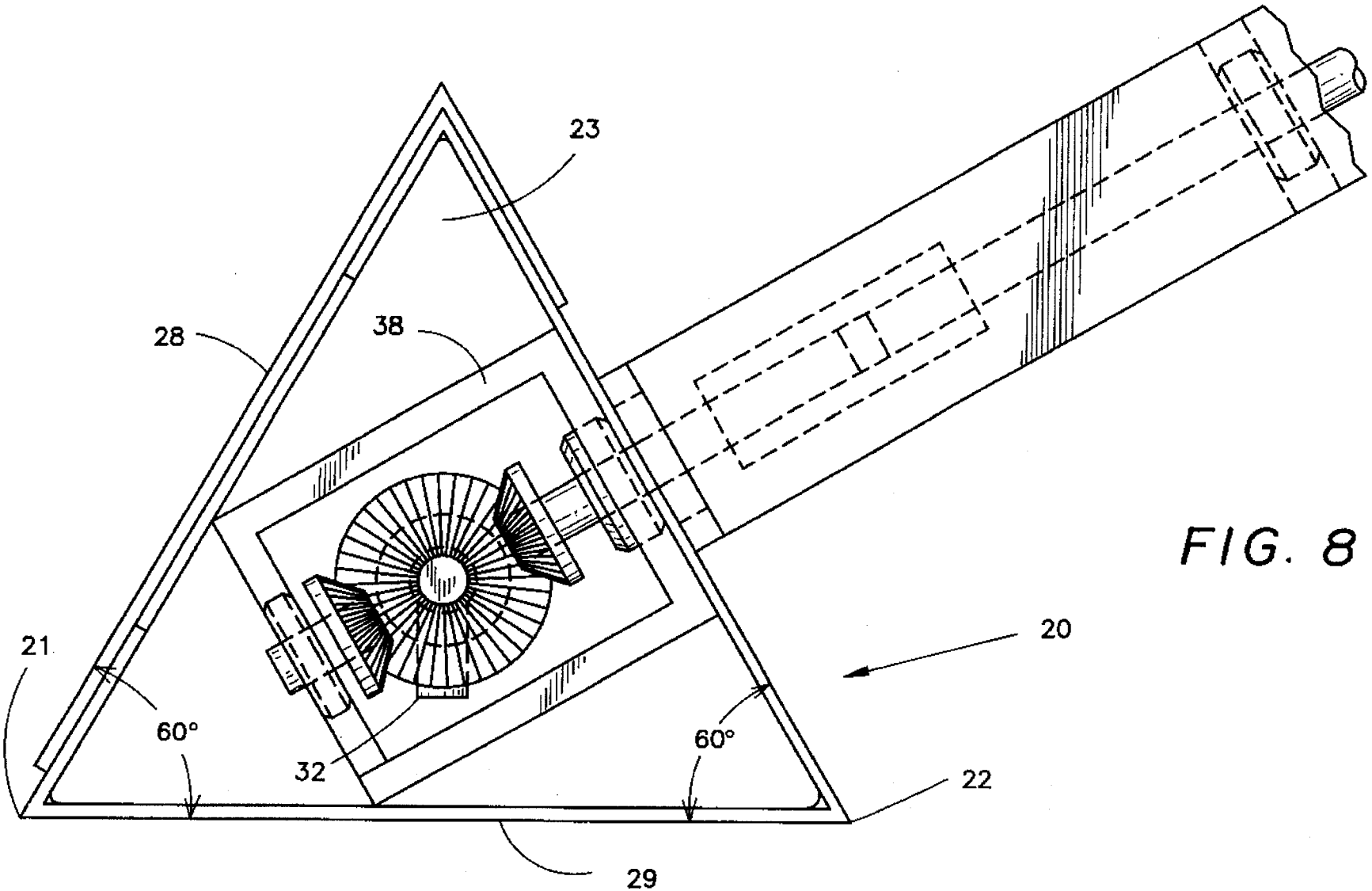
FIG. 8 is a side view of a second embodiment wherein the screed blade is made from an extruded tube.

Screed blade 20 is generally tubular, about 10 feet in length, and includes reinforcing plates 23 spaced along its length and end plates 24 on opposed ends in order to provide a watertight enclosure. In the preferred embodiment, the blade is triangular in cross-section, however, various other geometric shapes are contemplated as long as the front 21 and rear 22 lower edges, or concrete engaging edges, are angled at approximately 60 degrees, see FIG. 4. Screed blade 20 may be made from various materials but aluminum has been found to be the most satisfactory. As shown in FIG. 4., screed blade 20 is made from a first angular channel 26 having an open end 27 and a second angular channel member 25 which covers slot 27 in order to form a watertight enclosure. Alternatively, as shown in FIG. 8 the blade may be extruded in one angular tube 28 enclosed by end plates 24. It is an important aspect of the invention that screed blade 20 be hollow, watertight and have a front and rear concrete engaging edge angled at approximately 60 degrees. Further, the bottom surface 29 of second channel 25 which extends between front edge 21 and rear edge 22 is flat and approximately 6 inches in width.

Figure 5:
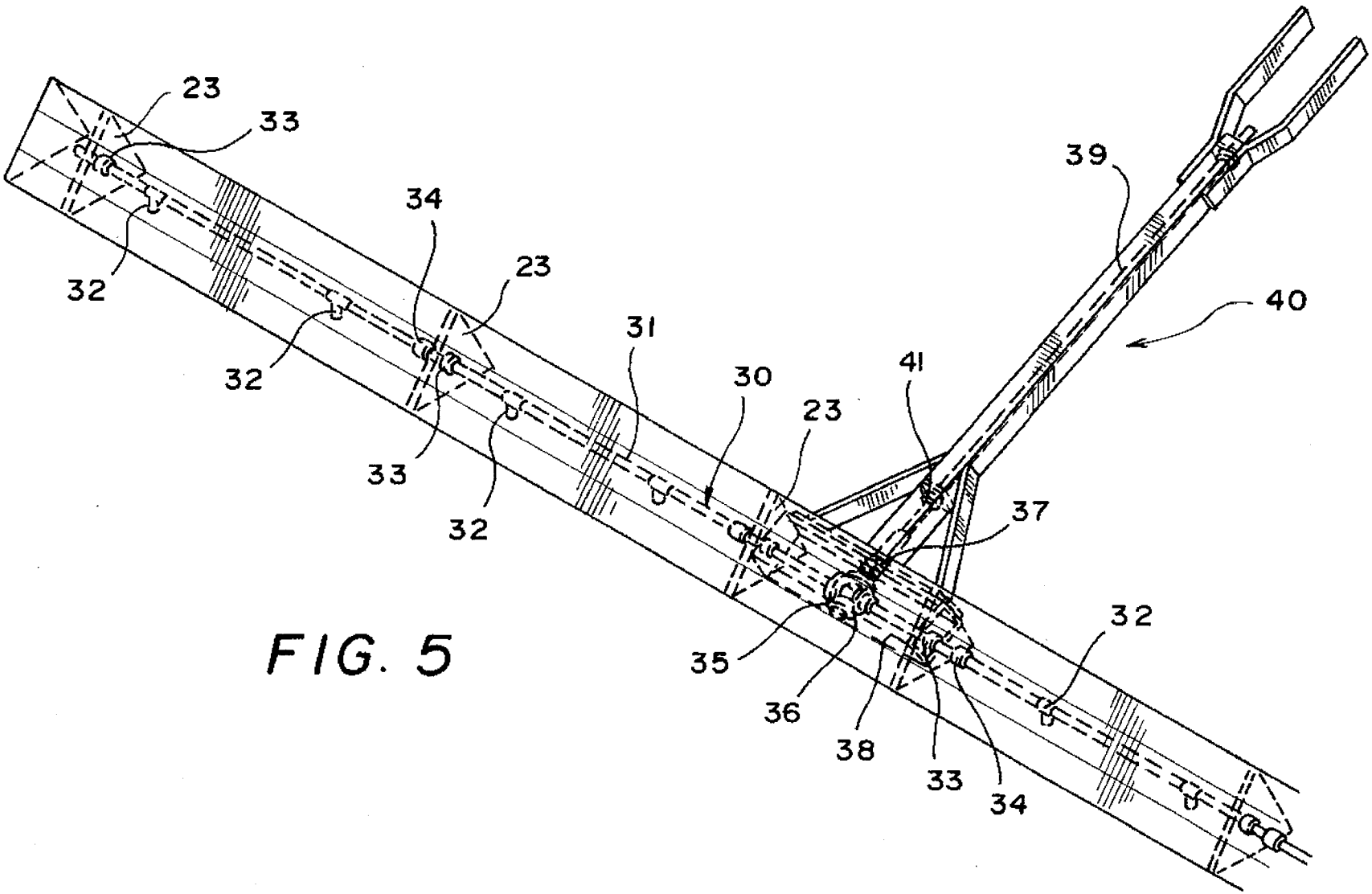
FIG. 5 is a diagrammatic view of a perspective skeletal view illustrating the vibratory system; and, FIG. 6 is a perspective skeletal view of the portable vibratory screed handle assembly shown in FIG. 1.
Figure 7:
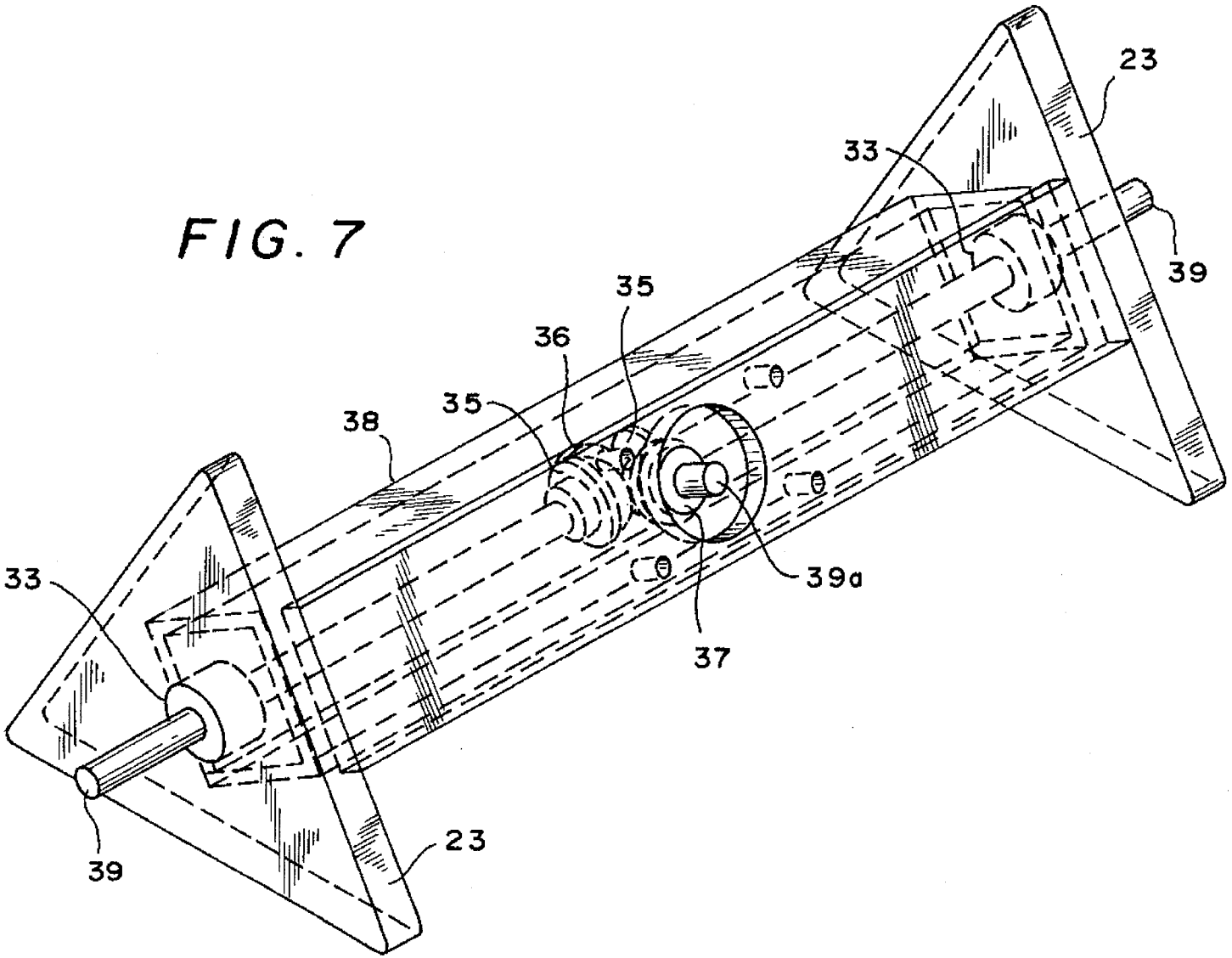
FIG. 7 is an enlarged isometric view of the gear box used in the present invention.

Contained within screed blade 20 is a vibratory system 30 which functions to vibrate the screed blade during operation. Vibratory system 30, as best viewed in FIGS. 4, 5 and 7, includes a rotatable shaft 31, which may be form in two sections. Mounted eccentrically on the shaft are a plurality of weights 32. When shaft 31 is driven, weights 32 will rotate thereby causing screed blade 20 to vibrate due to their eccentric mounting. As the screed blade 20 vibrates, the flat aluminum bottom surface 29 functions to produce a smooth, near final finish while the vibratory action tamps the rock down and works the fat to the concrete surface, thereby substantially increasing the finishing time while making the finisher's job much easier. Shaft 31 is supported to rotate by bearings 33 located in end plates 24 and a plurality of reinforcing plates 23. Shaft 31 is prevented from lateral movement by a combination of spaced stops 34 and bearings 33. Mounted to rotate with shaft 31 and contained within screed blade 20 is a drive gear 35 at the end of each shaft section 31. Drive gears 35 cooperate with a driven gear 36 positioned at the end of a second rotating shaft 39 in order to rotate therewith as second shaft 39 is driven by motor assembly 50. Driven gear 36 and drive gears 35 are all contained within a gear box 38. The lower portion a of second shaft 39 is mounted and supported so as to cooperate with a bearing 37 in gear box 38. Second shaft 39 is perpendicular to shaft 31 and is supported coaxially within handle assembly 40 via spaced bearings 41. Second shaft 39 may be unitary or it may be formed in two sections **39*a* and 39*b* and secured together by a coupling 42. If second shaft 39 is formed in two sections a smaller aperture in the rear surface of screed blade 20 can be accomplished, as only section 39*a*** will be required to extended through said surface.

Figure 6:
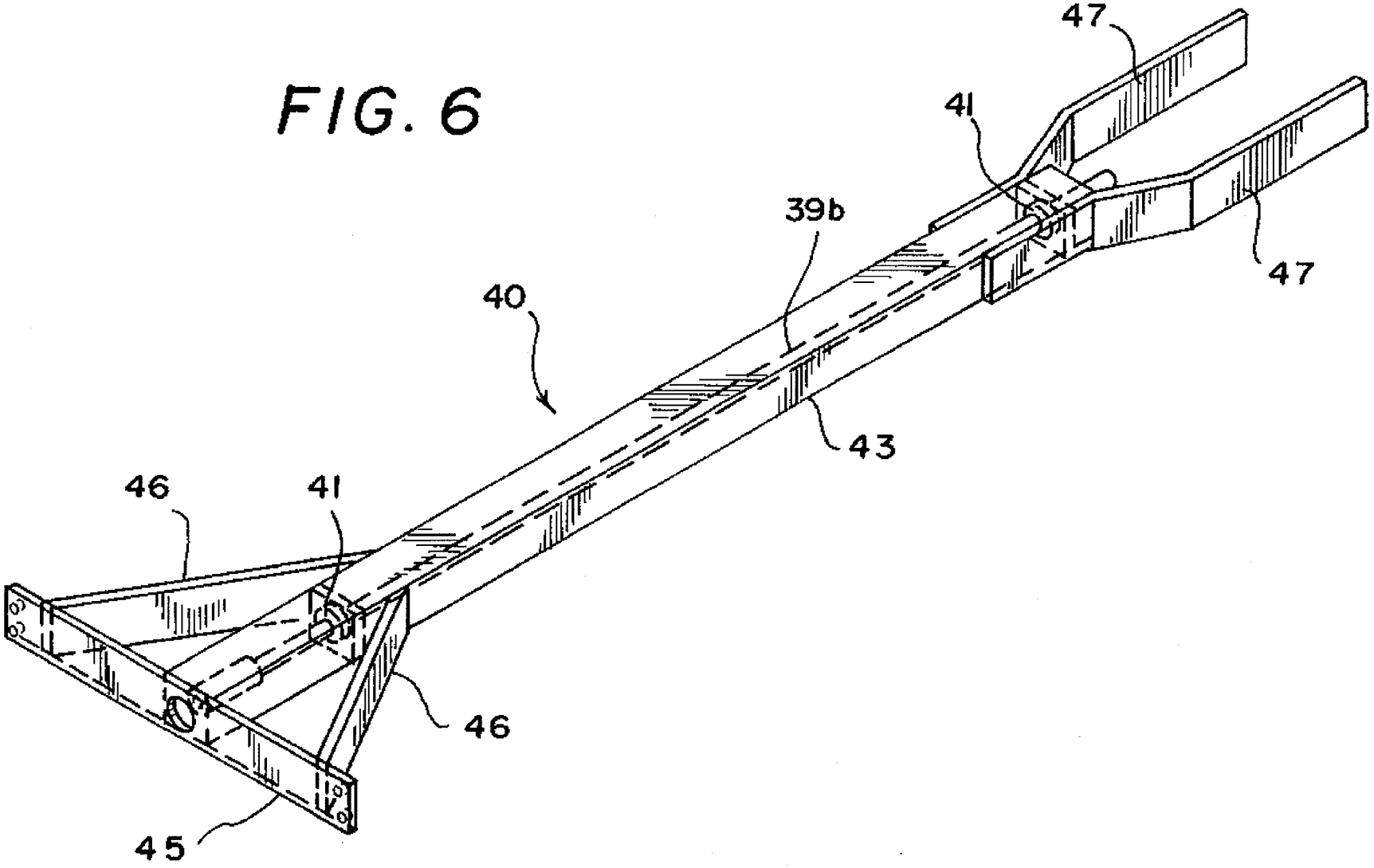

Turning to FIG. 6., the handle assembly 40 will be described. Handle assembly 40 again is preferably made from aluminum in order to aid in maintaining the overall weight of the device. Handle assembly 40 includes a housing 43 for enclosing second shaft 39. The housing 43 may be circular, square or rectangular. At a first end of handle assembly 40 is a screed blade mounting arrangement in the form of a bracket 45 with stability arms 46 extending therefrom and rigidly mounted to housing 43. A plurality of fasteners 44 function to rigidly secure bracket 45 to the rear surface of screed blade 20 while aligning second shaft 39 with driven gear 37 or with coupling 42. At the second opposite end of handle assembly is a motor mounting arrangement in the form of two bent brackets 47 rigidly secured to housing 43 by any suitable means.

FIG. 1 displays a motor assembly 50 for driving second shaft 39 which, in turn, drives shaft 31 to create the vibration. Motor assembly 50 includes a gas powered engine 51, a drive spindle 52, handgrips 53 and throtle control 54. The engine 51 is a conventional item such as those commonly used to drive grass trimming devices and is removably mounted such that spindle 52 engages the portion of second shaft 39 extending out of housing 43.

In operation, the operator stands in freshly poured concrete and allows the screed blade to float while they "Wet Screeds" a 10 foot wide section of concrete while others work around the operator to rake concrete to the areas necessary. If the amount of concrete needs to be cut down, the operator lowers the handle which causes 60 degree rear edge 22 to remove concrete from the area thereby lowering the grade height. If handle 40 is raised, the front 60 degree angled surface of the screed blade 20 functions to float over and tamp down to maintain the desired grade. The flat bottom surface 29 extending from the front angled edge 21 to the rear angled edge 22 of the screed blade functions to produce a smooth, near final finish while the vibratory action tamps the rock down and works the fat to the concrete surface, thereby substantially increasing the finishing time while making the finisher's job much easier. Referring to FIG. 1, 70 depicts a smooth finished "Wet Screed" area and 71 represents the area which needs to be worked.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. A portable vibratory concrete screed comprising:

an elongated, enclosed, hollow screed blade having a front concrete engaging surface, a rear concrete engaging surface and a flat bottom surface, wherein said front surface is coupled to said bottom surface forming a front concrete engaging edge and said rear surface is coupled to said bottom surface forming a rear concrete engaging edge, and wherein said front surface and front edge are at a 60 degree angle with respect to said bottom surface and said rear surface and said rear edge are at a 60 degree angle with respect to said bottom surface;

a vibratory system including a rotating shaft associated with said screed blade;

a handle assembly extending from said screed blade; and said handle assembly including a driven shaft which operably cooperates with and drives the shaft of said vibratory system.

2. The invention of claim 1, wherein said rotating shaft includes weights mounted eccentrically thereon.

3. The invention of claim 1, further including an engine connected to said driven shaft.

4. The invention of claim 1, wherein said rotating shaft is formed from two sections.

5. The invention of claim 1, wherein said tubular screed blade is formed from two angular lengths of metal.

6. The invention of claim 1, wherein said tubular screed blade is formed from a hollow extrusion.

7. The invention of claim 1, wherein said tubular screed blade is less than 12 feet in length.

8. A portable vibratory concrete screed comprising:

an elongated tubular screed blade which is triangular in cross section and includes a pair of opposed sides, a bottom and a pair of opposed ends, thereby forming an enclosed triangular blade;

a vibratory system associated with said screed blade;

a handle assembly extending from one side of said triangular shaped screed blade; and said handle assembly including a motor driven shaft which operably cooperates with and drives the vibratory system.

9. The invention of claim 8, wherein the vibratory system includes a shaft supported with said screed blade with weights mounted eccentrically thereon which operatively engages said motor driven shaft.

10. The invention of claim 8, wherein said motor driven shaft is formed in two sections with a coupling securing said sections together.

11. The invention of claim 8, wherein the handle assembly further includes a throttle control for operation by a user.

12. The invention of claim 8, wherein said tubular screed blade is formed from two angular lengths of metal.

* * * * *